United States Patent [19]

Cahalan

[11] Patent Number: 4,629,398

[45] Date of Patent: Dec. 16, 1986

[54] OIL DETECTING SWITCH FOR CONTROLLING A PUMP

[75] Inventor: Irving W. Cahalan, Huntington Station, N.Y.

[73] Assignee: Hazeltine Corporation, Commack, N.Y.

[21] Appl. No.: 731,636

[22] Filed: May 7, 1985

[51] Int. Cl.[4] ..... F04B 49/00; G08B 21/00

[52] U.S. Cl. ..... 417/1; 417/40; 417/63; 340/623; 307/118; 73/440

[58] Field of Search ..... 417/1, 36, 40, 44, 63; 307/118; 200/84 R; 73/307, 311, 440; 340/623, 625

[56] References Cited

U.S. PATENT DOCUMENTS

| | | | |
|---|---|---|---|
| 2,463,703 | 3/1949 | Legler | 417/36 X |
| 2,468,791 | 5/1949 | Thomson | 417/1 X |
| 2,691,296 | 10/1954 | DeGiers | 73/440 |
| 2,926,528 | 3/1960 | DeGiers | 73/440 |
| 3,005,068 | 10/1961 | Pollak | 200/84 R |
| 4,466,777 | 8/1984 | Kimberlin | 417/63 X |
| 4,586,033 | 4/1986 | Andrejasich | 417/36 X |

*Primary Examiner*—Carlton R. Croyle
*Assistant Examiner*—Paul F. Neils
*Attorney, Agent, or Firm*—E. A. Onders; F. R. Agovino

[57] ABSTRACT

The oil detecting switch includes a light oil float switch, a water float switch and a heavy oil float switch. When the light oil float switch is closed, a relay is activated energizing a light oil indicator light and its associated coil. The coil is part of a relay which inhibits pumping action. When the water float switch is activated, the inhibiting relay is bypassed so that pumping action can continue. When the heavy oil float switch is activated and closed, a relay is activated which energizes a heavy oil indicator light and its associated coil. The coil is part of a relay which inhibits pumping action. The light oil indicator light, its associated coil and the water indicator light are bypassed when the heavy oil float switch is activated. The status of the float switches is monitored by an analog-to-digital converter associated with a Remote Monitoring System Transmitter.

18 Claims, 2 Drawing Figures

OIL DETECTING SWITCH FOR CONTROLLING A PUMP

BACKGROUND OF THE INVENTION

1. Field of the Invention

The invention generally relates to a switch for controlling a pump and, in particular, a switch for detecting fluids such as oil and for controlling pump action in response to such detection.

2. Description of the Prior Art

Float switches for controlling pumps are well known in the prior art. However, such switches generally activate or deactivate pumps based on fluid level. Prior art pump controls are generally unable to distinguish between the specific gravities of such fluids as light oil, water and heavy oil and controlling pump action in response to the detection of the fluids having such specific gravity. The invention is directed to solving this problem.

SUMMARY OF THE INVENTION

It is an object of this invention to provide a oil detecting switch for controlling a pump which can distinguish between a fluid such as water having a specific gravity of approximately 1.0 and a second fluid such as light oil having a specific gravity of approximately 0.5.

It is a further object of this invention to provide an oil detecting switch which can also detect a fluid such as heavy oil having a specific gravity of approximately 1.2.

It is a further object of this invention to provide a switch for controlling a pump which will inhibit the pumping of light oil but which will permit the pumping of water.

It is another object of this invention to provide an oil detecting switch for controlling a pump which will inhibit the pumping of oil and will permit the pumping of light oil or heavy water.

The apparatus according to the invention is for controlling a pump located in a chamber when certain fluids are present in the chamber. The apparatus comprises a control means for normally permitting pump operation and for inhibiting the pump when the inhibiting means is activated. First detection means detects the presence in the chamber of a first fluid having a specific gravity equal to or greater than a first specific gravity. First activation means, responsive to the first detection means, activates the pump upon detection of the first fluid by the first detection means. Second detection means detects the presence in the chamber of a second fluid having a specific gravity equal to or greater than a second specific gravity. A bypass relay responsive to the second detection means, bypasses said first activation means upon detection of the second fluid by the second detection means. The second specific gravity may be greater than the first specific gravity. Third detection means detects the presence in the chamber of a third fluid having a specific gravity greater than or equal to a third specific gravity. An inhibit, responsive to the third detection means, bypasses the first activation means and activates the inhibiting control upon detection of the third fluid by the third detection means. The third specific gravity may be less than the first specific gravity.

For a better understanding of the present invention, together with other and further objects, reference is made to the following description, taken in conjunction with the accompanying drawing, and its scope will be pointed out in the appended claims.

DETAILED DESCRIPTION OF THE INVENTION

The oil detecting switch according to the invention would be used in combination with a pump located in a fluid chamber. For example, underground transformers are generally located in underground chambers which tend to fill with water during rainstorms or when the water table level is higher than the level of the chamber. For safety and maintenance reasons, such underground transformer chambers are generally provided with a pump to prevent the chamber from filling with water. Underground transformers generally use various types of oil to maintain cooling. On occasion, the oil cooling system of the transformer ruptures or otherwise leaks and causes oil to enter the transformer chamber. For environmental reasons, it is generally undesirable to pump any oil when a rupture or leak has occurred. One purpose of the invention is for use in combination with a pump located in a transformer chamber to inhibit pump action when oil is detected.

Figure 1:
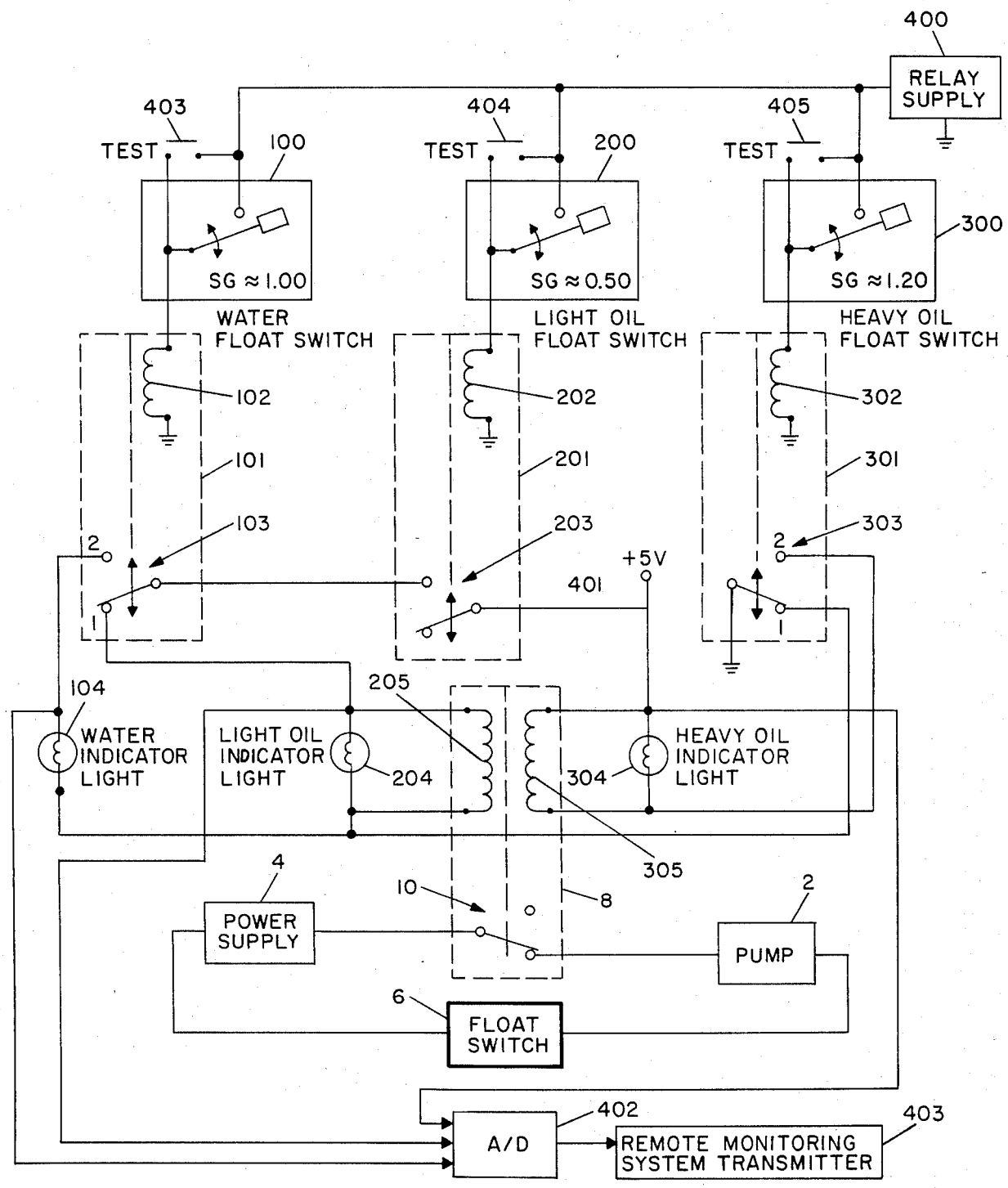
FIG. 1 is a circuit diagram illustrating an oil detecting switch for controlling a pump in accordance with the invention.

As shown in FIG. 1, pump 2 may be located in a chamber such as an underground transformer chamber and connected to power supply 4. Float switch 6 in series connection between pump 2 and power supply 4 detects the presence of any fluid (having a specific gravity greater than 0.5, for example) within the chamber and closes upon detection of a fluid to activate pump 2. According to the invention, normally closed relay 8 (power relay) is also placed in series between pump 2 and power supply 4 to control the operation of pump 2. Relay 8 is an inhibit means which inhibits operation of pump 2.

A preferred embodiment of the invention includes water float switch 100, light oil float switch 200 and heavy oil float switch 300. However, it is contemplated that the invention may only include water float switch 100 and light oil float switch 200 or include the combination of water float switch 100 and heavy oil float switch 300. In addition, it is also contemplated that the invention may be configured to pump any two fluids such as light oil and water but not pump other fluids such as heavy oil. For example, certain light oils, when treated with flame retardants become heavy oil. It may be environmentally acceptable to pump light oil whereas the flame retardants may be chemicals which are environmentally unacceptable so that it would be environmentally unacceptable to pump heavy oil.

Float 100 is a first detection means and includes a float which is water sensitive. In particular, water float switch 100 would activate upon detection of fluids having a specific gravity of approximately 1.00. Water generally has a specific gravity of 1.00, depending on temperature, so it is desirable to have water float switch 100 having a sensitivity to fluids having a specific gravity slightly below 1.00. In fact, switch 100 could be sensitive to any particular specific gravity depending on the fluid which is to be detected and pumped.

The third detection means, light oil float switch 200, is configured to close upon detection of a fluid having a specific gravity of 0.50 or greater. Upon closing of float switch 200, relay supply 400 is connected to coil 202 of normally open relay 201 inhibit relay closing contacts 203. This results in power supply 401 being connected through contacts 203 through position 1 of contacts 103 to light oil indicator light 204. The opposite side of light 204 is connected to position 1 of contacts 303 which is grounded. Connected in parallel with light oil indicator light 204 is coil 205 of normally closed relay 8. Coil 205 is also energized activating normally closed relay 8 and resulting in contacts 10 being opened. As a result, pump 2 becomes inhibited because an open circuit exists between pump 2 and power supply 4.

Float switch 100 is connected between relay supply 400 and two position relay 101 which functions as the bypass relay of the invention. Upon detecting of a fluid having a specific gravity of approximately 1.00 or greater, the second detection means in the form of water float switch 100 closes thereby providing current to coil 102 to activate relay 101. Upon activation of relay 101, contact switch 103 is moved from position 1 to position 2. The specific gravity of the fluid activating water float switch 100 must be about 1.00 or greater. This also results in the closing of light oil float switch 200 which activates relay 201 to close contacts 203. As a result, five volt power supply 401 is connected through contacts 203 and through position 2 of contacts 103 activating the water indicator light 104. The other side of water light 104 is connected to position 1 of contacts 303 which is grounded thereby closing the circuit and energizing light 104. Relay 101 functions as a bypass means because switching from position 1 to position 2 of contacts 103 results in light 204 and its associated coil 205 being bypassed. By being bypassed, it is meant that one side of light 204 and coil 205 are connected to position 1 of relay 101 which is an open circuit when contacts 103 are in position 2.

Heavy oil float switch 300 (second detection means) is configured to activate and close when being immersed in a fluid having a specific gravity of 1.20 or greater. Upon closing of float switch 300, relay supply 400 is connected to two position relay 301 (second activation means) energizing coil 302 and moving contacts 303 from position 1 to position 2. By grounding contact 2, heavy oil indicator light 304 is energized because the other side of light 304 is connected to supply 401. Parallel coil 305 is also energized which activates normally closed relay 8 to open contacts 10 and inhibit pump 12.

Generally, water float switch 100, light oil float switch 200 and heavy oil float switch 300 would all be located in a vicinity close to the inlet of pump 2. Therefore, closing of switch 100 due to immersion in water would also result in closing of switch 200 but would not result in the closing of switch 300. Closing of switch 300 as a result of immersion in heavy oil would also result in closing of switches 100 and 200. However, relay 301 also functions as a bypass means in that activation thereof results in position 1 of contacts 303 becoming an open circuit. This open circuit prevents energizing of water indicator light 104 or light oil indicator light 204 or its associated coil 205.

Each of the float switches may be provided with an optional test switch such as illustrated in FIG. 1 by reference characters 403, 404 and 405. As noted above, the invention may include any two of the switches 100, 200 or 300 depending on the particular type of pumping action and pumping inhibition that is desired. For example, if it is desired to pump light oil but not heavy oil, coil 205 and its associated circuitry are unnecessary.

Figure 2:
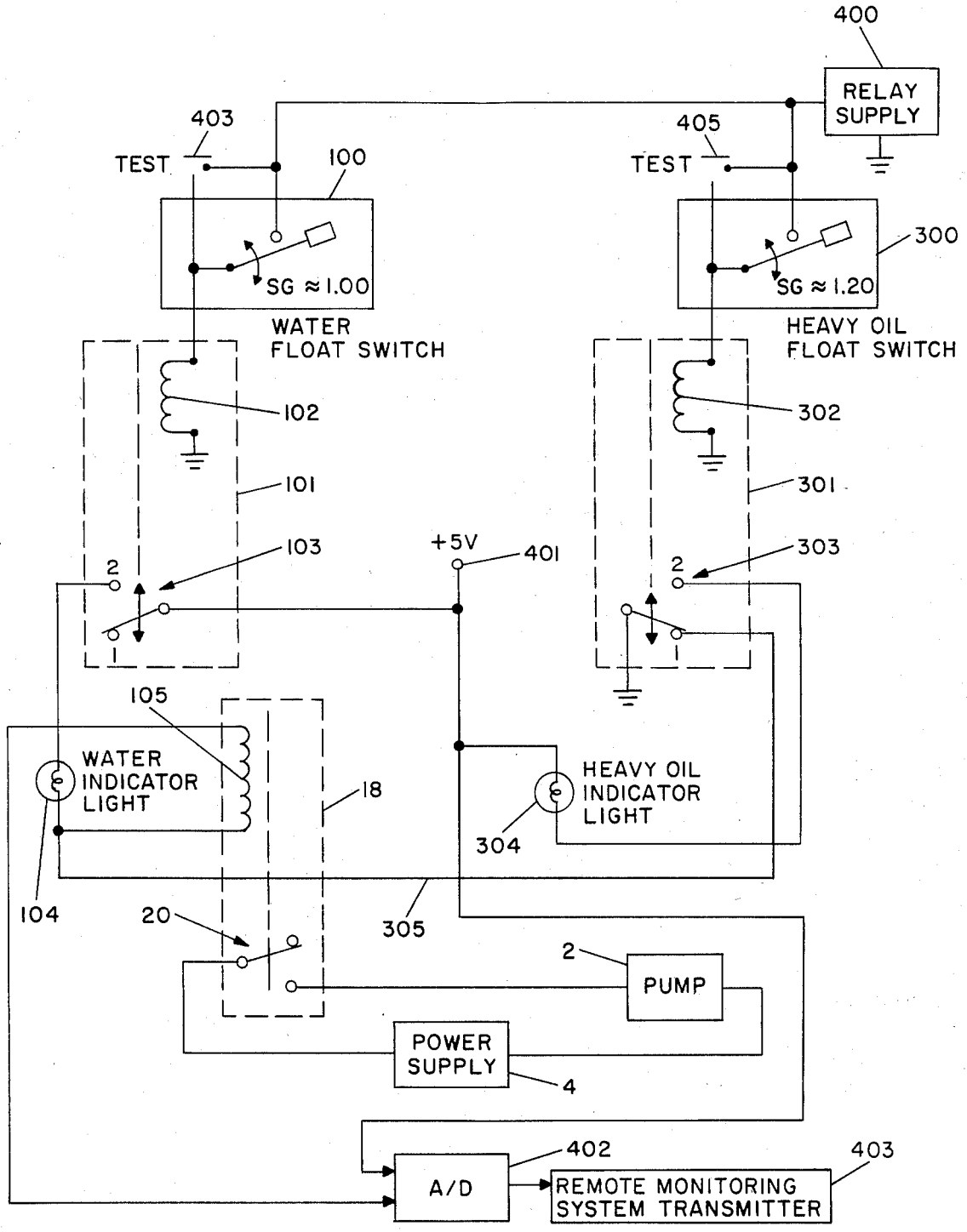
FIG. 2 is a circuit diagram of another embodiment of the invention of FIG. 1.

Although the invention has been described in accordance with the circuit illustrated in FIG. 1, various changes will be apparent to those skilled in the art. For example, the normally open switches may be replaced with normally closed switches or multiposition relays may replace one or more of the relays of FIG. 1. FIG. 2 illustrates an alternative embodiment wherein float switch 6 is eliminated and relay 18 directly controls pump 2. Switch 20 is closed upon activation of coil 105 as a result of switch 103 of relay 101 moving from position 1 to position 2. Although not shown, the embodiment of FIG. 2 may include a light oil float and associated relay and light connected to A/D converter 402 so that the presence of light oil can also be monitored.

RMS TRANSMITTER INTERCONNECTION

It is also contemplated that the oil detecting switch according to the invention may be associated with a Remote Monitoring System (RMS) Transmitter 403. Frequently, underground transformers are provided with RMS Transmitters which monitor the transformer condition. One example of a Remote Monitoring transmitter is described and disclosed in U.S. Pat. No. 4,535,477, incorporated herein by reference. Transmitters of the type as described in U.S. Pat. No. 4,535,447 are used with a power distribution network and provide information over the power lines of the network to a central monitoring station.

In conjunction with a Remote Monitoring System Transmitter, the status of the oil detecting switch according to the invention could be provided to a Remote Monitoring System Transmitter so that information relating to the status would be transmitted to the central monitoring station. For example, lights 104, 204 and 304 may be provided to an analog-to-digital converter which would be connected to a Remote Monitoring System Transmitter. Converter 402 would continuously indicate to the transmitter the status of lights 104, 204 and 304 resulting in the status of the oil detecting switch according to the invention being communicated to the central monitor of the RMS Transmitter System.

OPERATION OF THE INVENTION

Float switches 100, 200 and 300 should be located near the inlet of pump 2 to detect the specific gravity of the fluid which is being supplied to the inlet. When the oil detecting switch according to the invention is immersed in light oil having a specific gravity in the range of 0.50–0.99, light oil float switch 200 is closed and water float switch 100 and heavy oil float switch 300 remain open. As a result of the closing of switch 200, relay 201 is activated closing contacts 203. This results in power supply 401 being supplied through position 1 of contacts 103 to light oil indicator light 204 and coil 205. Energizing of coil 205 results in the activation of relay 8 thereby opening contacts 10 and inhibiting pump 2.

Upon immersion of the oil detecting switch according to the invention in a fluid having a specific gravity in the range of 1.00 to 1.19, light oil float switch 200 and water float switch 100 are closed. This results in energizing of coils 202 and 102 so that contacts 203 are closed and contacts 103 are in position 2. Five volt power supply 401 is conducted through contacts 203 and through the second position of contacts 103 to water indicator light 104. Relay 8 is *not* activated so that pump 2 is *not* inhibited because contact 103 is in position 2 resulting in position 1 being an open circuit so that no power is supplied to light oil indicator light 204 or its associated coil 205.

Upon immersion of the oil detecting switch in a fluid having a specific gravity of 1.20 or greater, heavy oil float switch 300, light oil float switch 200 and water float switch 100 are all closed. Relay 301 is activated resulting in contacts 303 moving to position 2 closing the circuit on heavy oil indicator light 304 and its associated coil 305. Relay 8 is thereby activated opening contacts 10 and inhibiting pump 2. However, light oil indicator light 204, its associated coil 205 and water indicator light 104 are bypassed and not energized because contact 303 is in position 2 resulting in position 1 being an open circuit.

For a better understanding of the present invention, together with other and further objects, reference is made to the following description, taken in conjunction with the accompanying drawings, and its scope will be pointed out in the appended claims.

While there have been described what are at present coonsidered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An apparatus for controlling a pump located in a chamber when certain fluids are present in the chamber, said apparatus comprising:

control means for normally permitting pump operation and for inhibiting pump operation when said control means is activated;

first detection means comprising a first float switch for detecting the presence in the chamber of a first fluid having a specific gravity equal to or greater than a first specific gravity, and activation means including a first relay, said activation means responsive to the first detection means and activating said pump upon detection of the first fluid by the first detection means, said first detection means controlling power supplied to said first relay;

second detection means comprising a second float switch for detecting the presence in the chamber of a second fluid having a specific gravity equal to or greater than a second specific gravity, and a bypass relay, responsive to the second detection means, for bypassing said activation means and for activating said control means to inhibit said pump operation upon detection of the second fluid, the second specific gravity being greater than the first specific gravity.

2. The apparatus of claim 1 further comprising third detection means for detecting the presence in the chamber of a third fluid having a specific gravity equal to or greater than a third specific gravity, and an inhibit relay responsive to the third detection means for bypassing said activation means and for activating said control means to inhibit said pump operation upon detection of the third fluid by the third detection means, the third specific gravity being less than the first specific gravity.

3. The apparatus of claim 1 including means, associated with said first detection means and said second detection means, for indicating the status of said first detection means and said secnd detection means to a Remote Monitoring System Transmitter.

4. The apparatus of claim 3 wherein said means for indicating comprises an analog-to-digital converter associated with a Remote Monitoring System Transmitter.

5. The apparatus of claim 1 wherein said control means comprises a power relay controlling power supplied to the pump, wherein said first relay controls power supplied to the power relay.

6. The apparatus of claim 5 wherein said bypass relay controls power supplied to the first relay, said second detection means controlling power supplied to the bypass relay.

7. The apparatus of claim 6 wherein said first float switch is a normally open switch which closes when immersed in a fluid having a specific gravity substantially equal to or greater than 1.0; and wherein said second float switch is a normally open switch which closes when immersed in a fluid having a specific gravity substantially equal to or greater than 1.2.

8. The apparatus of claim 7 wherein said inhibit relay is a normally open relay and said first and bypass relays are each a two position relay.

9. The apparatus of claim 8 further including means, associated with said first detection means and said second detection means, for indicating the status of said first detection means and said second detection means to a Remote Monitoring System Transmitter.

10. The apparatus of claim 9 wherein said means for indicating comprises an analog-to-digital converter associated with a Remote Monitoring System Transmitter.

11. The apparatus of claim 7 further comprising: third detection means for detecting the presence in the chamber of a third fluid having a specific gravity equal to or greater than a third specific gravity; an inhibit relay responsive to the third detection means, for bypassing said activation means and for activating said control means to inhibit said pump operation upon detection of the third fluid by the third detection means, the third specific gravity being less than the first specific gravity.

12. The apparatus of claim 11 wherein said third detection means is a third float switch which is a normally open switch which closes when immersed in a fluid having a specific gravity substantially equal to or greater than 0.5.

13. The apparatus of claim 12 wherein said first and bypass relays are each two-position relays, and said inhibit relay is a normally open relay.

14. The apparatus of claim 13 wherein a power supply is connected through the normally open inhibit relay and between the first position of the bypass relay and the second position of the first relay; wherein the first position of the first relay is connected to the first position of the bypass relay; and wherein said first relay is normally in the first position and said third relay is normally in the first position.

15. The apparatus of claim 14 wherein said power relay has a coil connected between the power supply and the second position of the bypass relay and further has a second coil connected between the first position of the first relay and the first position of the bypass relay.

16. The apparatus of claim 15 further comprising indicator lights connected in parallel with the coils and an indicator light connected between the second position of the first relay and the first position of the bypass relay.

17. The apparatus of claim 16 further including means, associated with said first detection means, said second detection means and said third detection means, for indicating the status of said first detection means, said second detection means and said third detection means to a Remote Monitoring System Transmitter.

18. The apparatus of claim 17 wherein said means for indicating comprises an analog-to-digital converter for providing a digital status signal to the Remote Monitoring System Transmitter.

* * * * *